US010695610B2

(12) United States Patent
Barrie

(10) Patent No.: US 10,695,610 B2
(45) Date of Patent: Jun. 30, 2020

(54) EXERCISE METHOD AND DEVICE

(71) Applicant: Theodore J. Barrie, Sterling Heights, MI (US)

(72) Inventor: Theodore J. Barrie, Sterling Heights, MI (US)

( * ) Notice: Subject to any disclaimer, the term of this patent is extended or adjusted under 35 U.S.C. 154(b) by 22 days.

(21) Appl. No.: 16/283,337

(22) Filed: Feb. 22, 2019

(65) Prior Publication Data

US 2019/0224526 A1 Jul. 25, 2019

Related U.S. Application Data

(63) Continuation of application No. 15/386,123, filed on Dec. 21, 2016, now abandoned.

(51) Int. Cl.
*A63B 23/12* (2006.01)
*A63B 21/00* (2006.01)

(52) U.S. Cl.
CPC ..... *A63B 23/1236* (2013.01); *A63B 21/4035* (2015.10)

(58) Field of Classification Search
CPC ..... A63B 23/1236; A63B 23/1227; A63B 21/4035; A63B 21/4033
See application file for complete search history.

(56) References Cited

U.S. PATENT DOCUMENTS 4,854,573 A * 8/1989 Johannson ..... A63B 23/12 482/141
5,181,897 A * 1/1993 Agan ..... A63B 23/12 482/141
D332,981 S * 2/1993 Poli ..... D21/686
D354,100 S * 1/1995 Tsay ..... D21/686
5,466,206 A * 11/1995 Fleming ..... A63B 23/12 482/141
5,718,622 A * 2/1998 Jones ..... B24D 15/04 451/523
7,780,575 B1 * 8/2010 Goodwin, III ..... A63B 1/00 482/34
8,343,021 B1 * 1/2013 Seraydarian ..... A63B 71/04 482/141
9,067,104 B1 * 6/2015 Kim ..... A63B 22/20
2013/0260970 A1 * 10/2013 Moskowich ..... A63B 23/1236 482/141
2013/0324382 A1 * 12/2013 Wilson ..... A63B 21/4039 482/142

* cited by examiner

*Primary Examiner* — Loan B Jimenez
*Assistant Examiner* — Shila Jalalzadeh Abyaneh
(74) *Attorney, Agent, or Firm* — Heed Law Group PLLC; Thomas P Heed

(57) ABSTRACT

An incline push-up stabilizer device and method, wherein the devise is comprised of a handle, spacer, and inflexible base. The inflexible base has a "W" profile, which allows the incline push-up stabilizer to temporarily, but securely, engage with a stair, so that a user may perform inclined push-ups. The incline push-up stabilizer device has a pair of orthogonally connected shared surfaces that are covered with a high-friction, flexible material, to create a gripping surface. The incline push-up stabilizer device is placed on a stair so that the gripping surface engages the stair. By doing push-ups on a positive incline, the user experiences less force with each push-up. This enables people who are fatigued, injured, out-of-shape, or old to perform push-ups.

13 Claims, 4 Drawing Sheets

EXERCISE METHOD AND DEVICE

CROSS REFERENCE TO RELATED APPLICATIONS

The present application is a continuation of U.S. Non-provisional Utility patent application Ser. No. 15/386,123, filed Dec. 21, 2016, and entitled, "EXERCISE METHOD AND DEVICE," which is incorporated herein by reference.

FIELD OF INVENTION

This invention relates to the class of exercise devices generally and, more particularly, to a method and device for performing push-ups.

BACKGROUND OF INVENTION

When working out, one conventional exercise is a pushup. Traditionally, pushups are performed in the prone position, with or without grips, blocks or supports. Most people remember push-ups from their gym class in secondary school. Push-ups are a basic exercise in military physical training ("PT"), and are widely used by private athletic trainers and physical educators.

Primarily, push-ups develop the pectoral muscles, biceps, and triceps; and secondarily, deltoids, rhomboids, trapezius, and latissimus dorsi. Additionally, push-ups allow for the free mobility of the scapulae. When done correctly, with one's shoulder blades separating and protracting at the top, the push-up is one of the best activators of the serratus anterior muscles. Push-ups also develop the core, under certain exercise circumstances. Last, push-ups are an indispensable exercise because they can be performed in bulk, anywhere. Repetition builds muscle bulk, or muscle hypertrophy. No other exercise is as accessible as the push-up while working such a variety of upper body muscle groups.

Although pushups may be an effective upper body exercise, there are many reasons that people are inhibited from doing push-ups. As a person fatigues, pushups become more difficult. When a person is injured, older, or out-of-shape, even a few push-ups may be difficult, or even painful. For many people, push-ups cause joint pain in the hands and wrists.

Although various devices for push-ups are defined in the prior art, such grips, blocks, and handles typically only provide stability and frictional engagement with the ground. Such grips, block, and handles reduce wrist and hand pain experienced by some users, but they do not provide any additional benefit over a regular prone push-up. The art discloses a variety of grips, blocks, and handles for facilitating push-ups in a full prone position. The art also discloses hybrid push-up devices that have some physical feature for forcing the user to engage core stability. Such hybrid devices often have rounded, triangular, or soft, inflatable bottoms, which facilitate core engagement by the user.

The market does disclose some general prior art attempting to act as an incline push-up stabilizer, but most of those devices have one or more flaws. For example, U.S. Pat. No. 5,181,897, by named inventor Agan ("Agan '897"), discloses a push-up stabilizer that has a thin, flat top region and two planes that engage a step or table edge. The two planes are very thin and not well-suited for their intended purpose. Apparently, in order to maximize the angle of incline, Agan '897 erred on the side of making the two planes so flat that they flex. Additionally, the thin, flat top region of the handle makes Agan '897 unstable. The two biggest requirements for an incline push-up stabilizer are that the handles create a stable base for the user, and the engagement planes do not flex. A flexing engagement plane will cause the engagement plane to lose contact and slide.

What the market needs is a push-up device that facilitates push-ups by stabilizing the user, reducing stress on the wrist and hands, and allowing the user to exercise at less than a full-prone position. By angling the users body with respect to the ground, the effective weight of the push-up experienced by the user is reduced. The effective angle of the user is 0° when doing a full prone push-up, which means that the push-up is being performed at the "standard" weight experienced by the user. The maximum effective angle for a user performing a positive inclined (head raised above feet) push-up is somewhere around 75°, meaning that, by selecting an appropriate angle, a user could perform push-ups with anywhere from approximately 0.25 times their "standard" weight ($\cos 75° \cong 0.25$) to their full "standard" weight, by selecting the appropriate positive incline for a push-up. The market is looking for a simple device that will allow all users to perform bulk push-ups. As a result, it is desirable to implement a workout handle that may be used to provide a variable inclined push-up position when connected to a stair or shelf.

SUMMARY OF THE INVENTION

This summary is intended to disclose the present invention, an incline push-up stabilizers, which facilitates push-ups, and its intended method of use. The present invention, an incline push-up stabilizers, comprises two individual incline push-up stabilizers, one for each of the intended user's hands. Each stabilizer is comprised of a handle, an inflexible base, a spacer, and a gripping surface.

The handle is designed to comfortably fit an adult's palm. As a result, the holding surface needs to be relatively wide and less rounded, in order to be more comfortable. The handle is textured to aid in gripping. Alternately, the exterior of the handle can be fabricated from a material with an easy to grip texture such as striated rubber or a thermoplastic elastomer ("TPE"). The handle is permanently attached to the spacers and inflexible base with an attaching means, such as a threaded fastener, adhesive, or thermoforming. The spacer is designed to provide additional clearance for the user's hand, to insure comfort while exercising.

The inflexible base has a "W" profile, with a rectangular upper region, in intimate contact with the spacers, and two lower triangular, wedged shaped regions. A gripping surface is adhered to the two orthogonally connected shared surfaces of the "W". The two orthogonally connected shared surfaces of the inflexible base form a 90° angle with respect to one another. The gripping surface allows the two orthogonally connected shared surfaces to have a high-friction engagement when the incline push-up stabilizers are placed on an appropriate surface, such as a stair, unmovable countertop, unmovable table, or similar unmovable piece of furniture. The gripping surface is fabricated a high surface friction, flexible material including, but not limited to, striated rubber, TPE, or textured nylon. The gripping surface is adhered to the orthogonally connected shared surfaces of the inflexible base with an adhering means, such as adhesive, threaded fastener, or overmolding.

The user can hold the incline push-up stabilizers by the handles and perform incline push-ups using any of the aforementioned solid structures: stairs, countertop, an immovable table, or a similar immovable piece of fixed furniture. The gripping surface will keep the incline push-up stabilizers from slipping or shifting during exercise. The inflexible base is wide enough to keep the incline push-up stabilizer stable, laterally.

The inflexible base and spacer are fabricated from a strong, environmentally durable material including, but not limited to, wood, nylon, poly(methyl-methacrylate) ("PMMA" or tradenames Plexiglass or Lucite®), polycarbonate ("PC" or tradename Lexan®), acrylonitrile butadiene styrene ("ABS"), polypropylene ("PP"), high-density polyethylene ("HDPE"), low-density polyethylene ("LDPE"), steel, zinc, or aluminum.

Likewise, the handle is fabricated from a strong, environmentally durable material including, but not limited to, wood, nylon, PMMA, PC, ABS, PP, HDPE, LDPE, steel, zinc, or aluminum. The handle, itself, needs to be either textured, or otherwise have a suitable gripping surface. A suitable gripping surface can be supplied by overmolding rubber or TPE onto the handle.

In the currently envisioned embodiment, the inflexible base and spacer would be integrally molded out of at least one of nylon, PP, ABS, or HDPE. In an alternative embodiment, the handle, spacer, and inflexible base are integrally molded from a single material, such as nylon, PP, ABS, or HDPE, and the gripping surface of the handles and the orthogonally connected shared surfaces of the inflexible base are overmolded onto the product.

The present invention clearly can be made in several embodiments by varying the components that are integrally molded and overmolded.

BRIEF DESCRIPTION OF THE DRAWINGS

The present invention is illustrated with 5 drawings on 4 sheets.

DETAILED DESCRIPTION OF THE DRAWINGS

Figure 1:
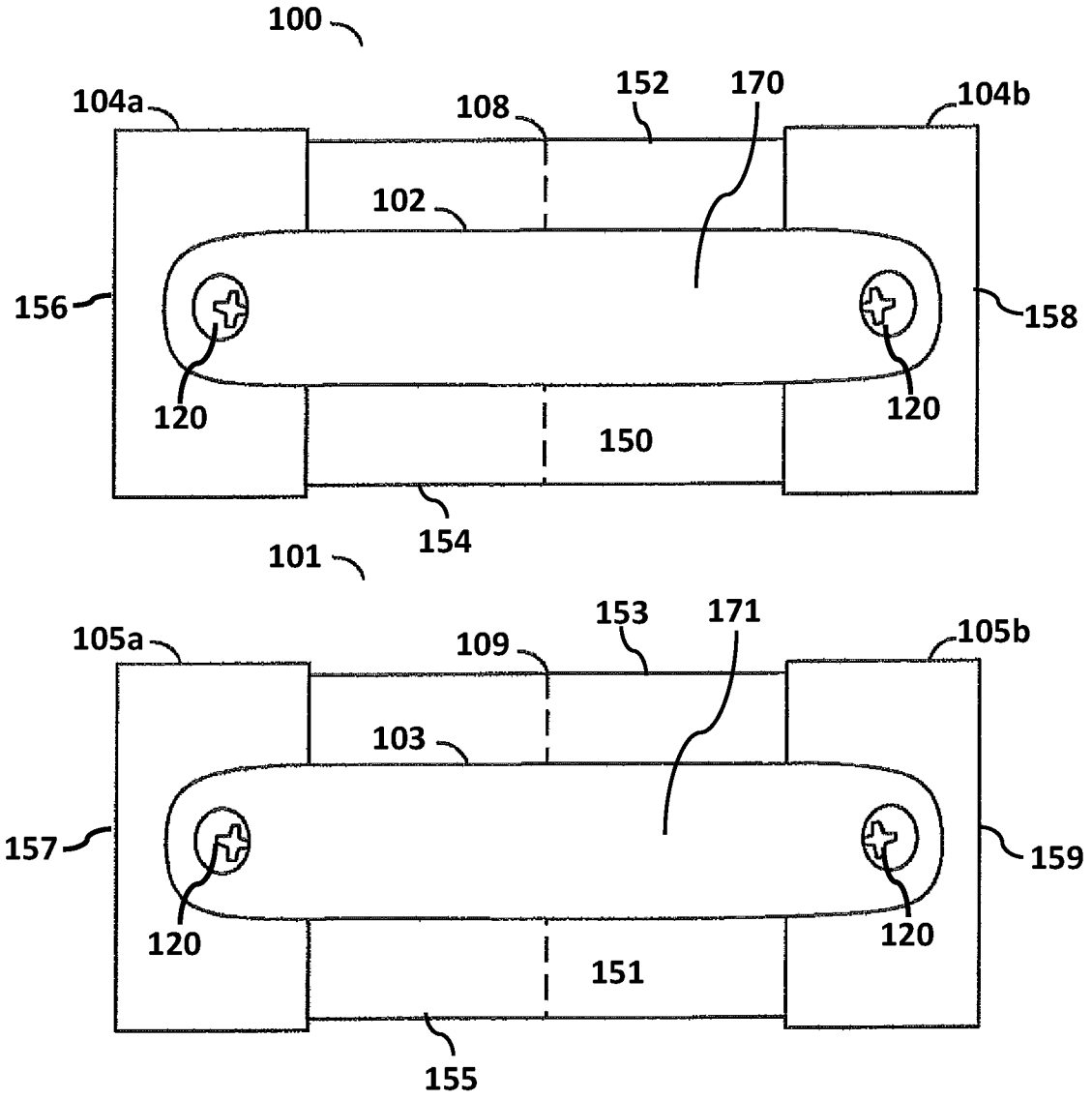
FIG. 1 is a top view of a pair of incline push-up stabilizers.
Figure 2:
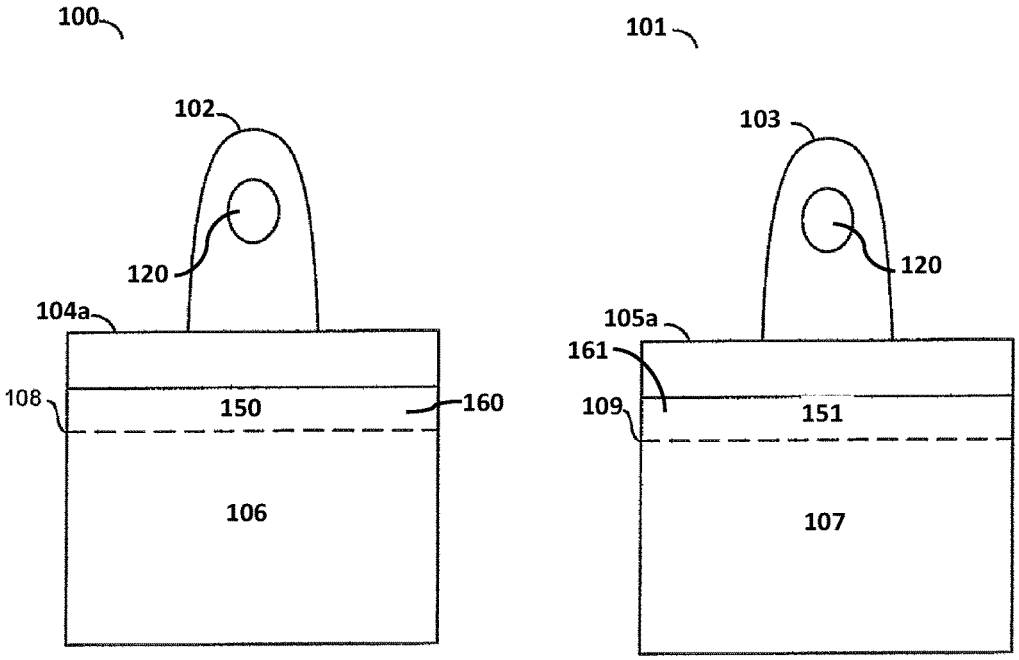
FIG. 2 is a top view of a pair of incline push-up stabilizers.
Figure 3:
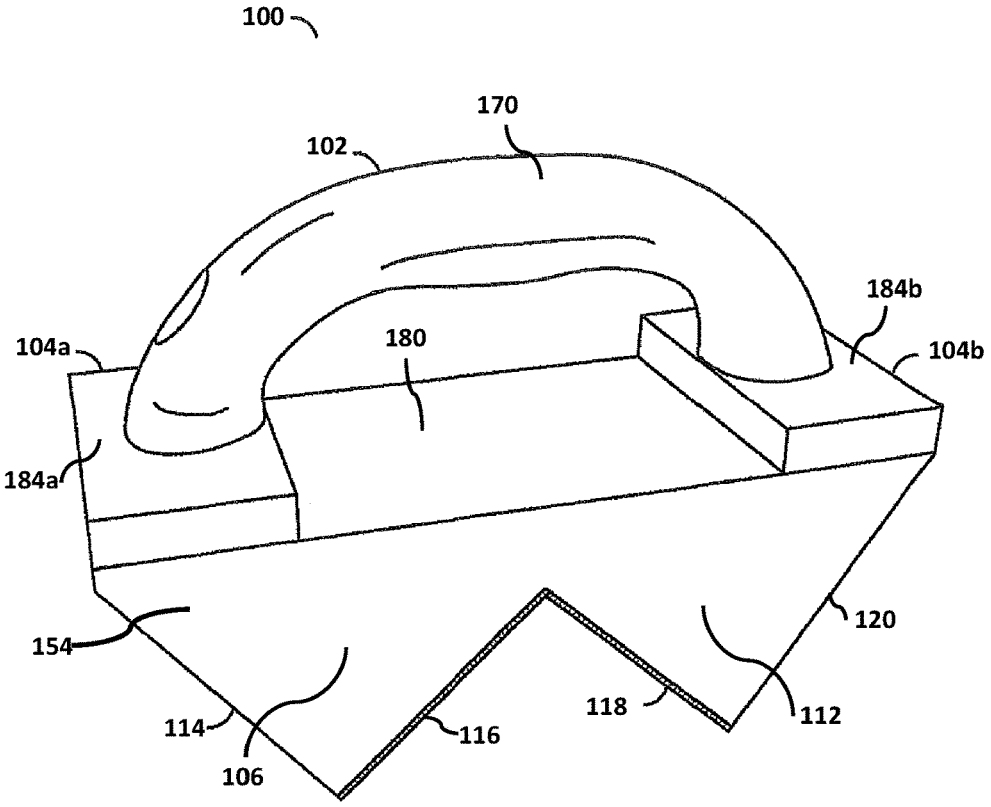
FIG. 3 is an isometric view of a single incline push-up stabilizer.
Figure 4A:
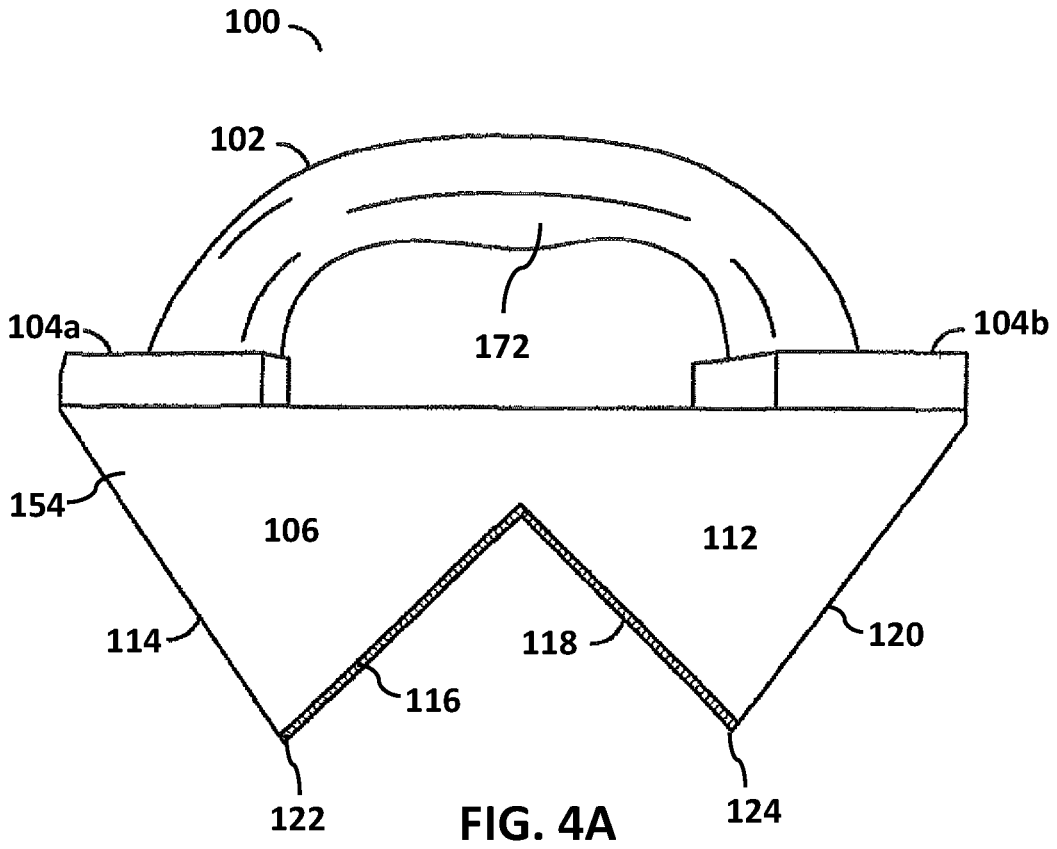
FIGS. 4A and 4B are lateral views of a pair of incline push-up stabilizers.
Figure 4B:
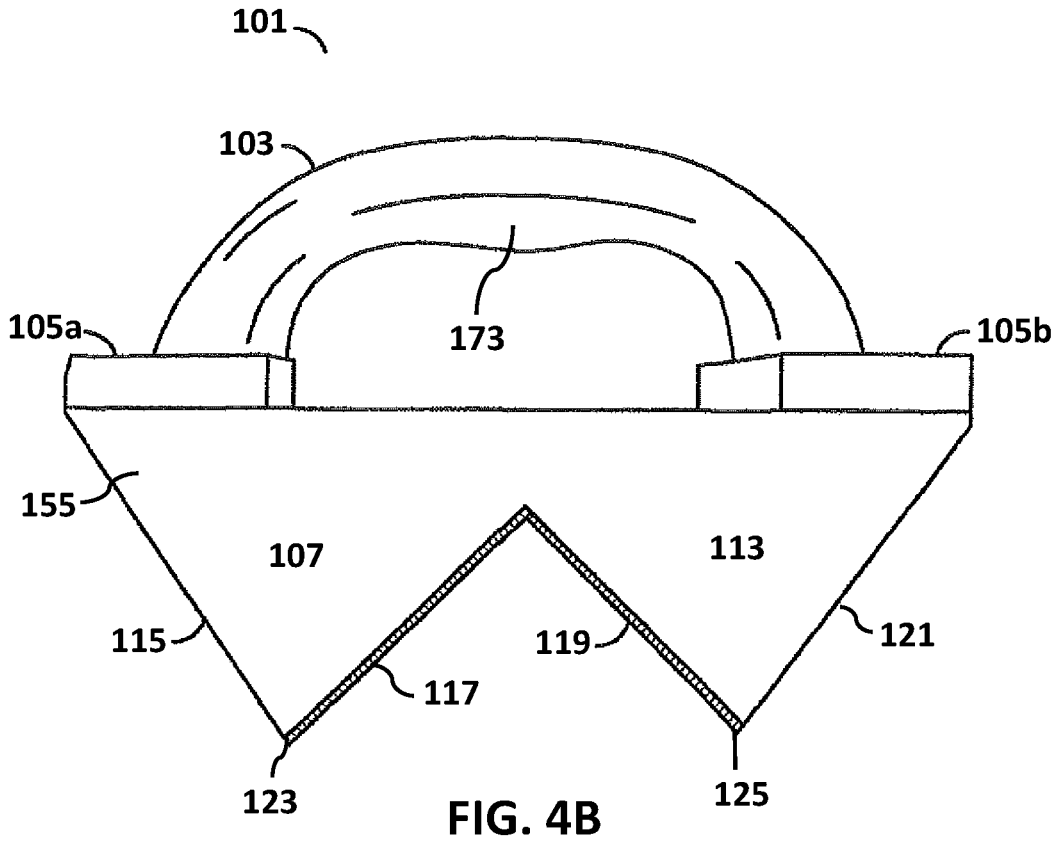

The following descriptions are not meant to limit the invention, but rather to add to the summary of invention, and illustrate the present invention, an incline push-up stabilizer. While embodiments of the invention are illustrated and described, the embodiments herein do not represent all possible forms of the invention. Rather, the descriptions, illustrations, and embodiments are intended to teach and inform without limiting the scope of the invention.

FIGS. 1-5 show the present invention 100, 101 a pair of incline push-up stabilizer 100, 101. The incline push-up stabilizer 100, 101 has two individual incline push-up stabilizers 100 and 101. A single incline push-up stabilizer 100, 101 would not fulfill its intended purpose. In the embodiment shown, a single incline push-up stabilizer 100, 101 is comprised of an inflexible base 150, 151, a handle 102, 103, a spacer 104*a*, 104*b*, 105*a*, 105*b*, and a gripping surface 200, 201.

The handle 102, 103 is attached to the spacer 104*a*, 104*b*, 105*a*, 105*b* and the inflexible base 150, 151 with an attaching means, such as a threaded fastener 120, adhesive, or overmolding. In the embodiment shown, the handle 102, 103 is attached to the spacer 104*a*, 104*b*, 105*a*, 105*b* and the inflexible base 150, 151 with threaded fasteners 120. The handle 102, 103 is fabricated from a strong, environmentally durable material including, but not limited to, wood, nylon, PMMA, PC, ABS, PP, HDPE, LDPE, steel, zinc, or aluminum. The surface 170, 171 of the handle 102, 103 needs to be either textured, or have a suitable gripping surface 170, 171. A suitable gripping surface 170, 171 can be supplied by overmolding striated rubber, TPE, textured nylon, or similar material onto the handle.

The spacer 104*a*, 104*b*, 105*a*, 105*b* provides additional clearance for the user's hand on the interior 172,173 of the handle 102, 103. The spacer 104*a*, 104*b*, 105*a*, 105*b* is permanently attached to the inflexible base 150, 151 with an attaching means such as such as a threaded fastener 120, adhesive, or overmolding. In the embodiment shown, the spacer 104*a*, 104*b*, 105*a*, 105*b* is attached to the inflexible base 150, 151 with threaded fasteners 120, which passes from the handle 102, 103 through the spacers 104*a*, 104*b*, 105*a*, 105*b*, and attaches to the inflexible base 150, 151. The handle 102, 103 is attached to the top surfaces 184*a*, 184*b* of the spacers 104*a*, 104*b*, 105*a*, 105*b*, It is imperative that the inflexible base 150, 151 of the incline push-up stabilizer 100, 101 not flex. The inflexible base 150, 151 is where the incline push-up stabilizer 100, 101 gets its stability. The inflexible base has a flat, rectangular region at the top 160, 161, a top surface 180, and two triangular wedge regions 106, 112, and 107, 113. The two triangular wedge regions 106, 112, and 107, 113 give the inflexible base 150, 151 a "W" profile 114, 116, 118, 120 and 115, 117, 119, 121. The W" profile 114, 116, 118, 120 and 115, 117, 119, 121 creates orthogonally connected shared surfaces 116, 118 and 117, 119. The two triangular wedge regions 106, 112, and 107, 113 come together at the centerline 108, 109 of the inflexible base 150, 151. Each inflexible base 150, 151 has two side surfaces 152, 154 and 153, 155, which define the overall length of the incline push-up stabilizer 100, 101. The spacer 104*a*, 104*b*, 105*a*, 105*b* and inflexible base 150, 151 has a width 156, 157, 158, 159. Each triangular wedge region 106, 112, and 107, 113 of each inflexible base 150, 151 has an apex 122, 124, 123, 125. When used on a flat surface, such as the floor, each individual incline push-up stabilizer 100, 101 rests on its apexes 122, 124 and 123, 125. The apexes 122, 124 and 123, 125 are the portion of the triangular wedge regions 106, 112, and 107, 113 furthest disposed from the handles 102, 103.

Figure 5:
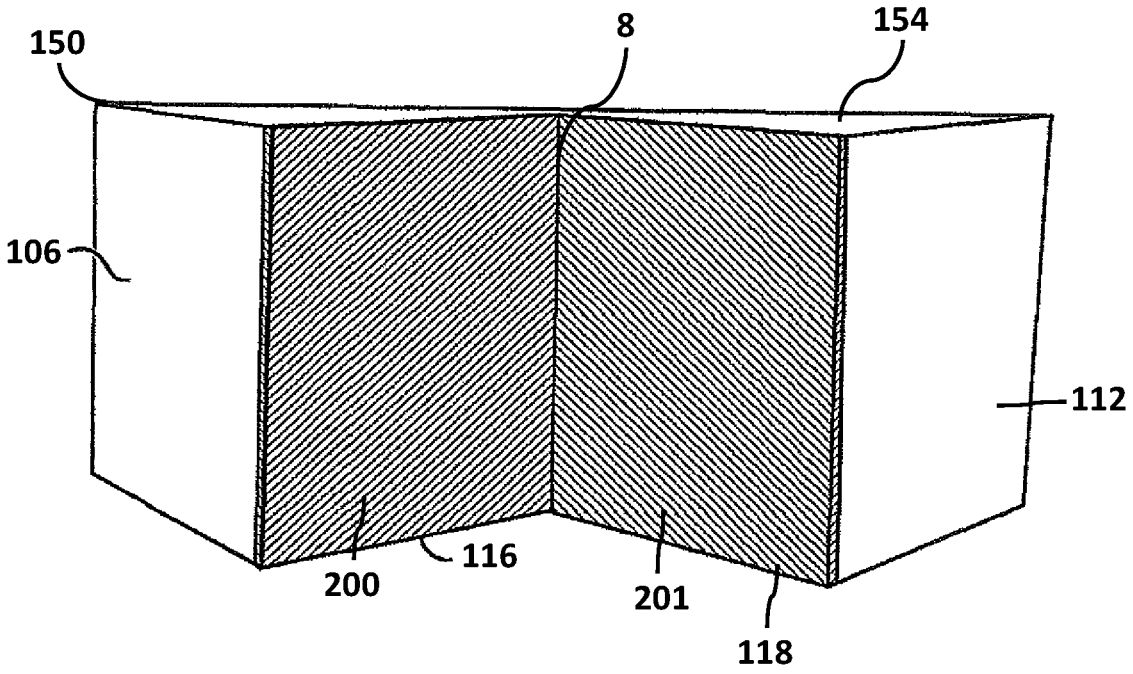
FIG. 5 is lateral view of the bottom of a single of incline push-up stabilizers.

FIG. 5 shows a single incline push-up stabilizer 100. The gripping surfaces 200, 201 are durably attached to the orthogonally connected shared surfaces 116, 118 of the triangular wedge region 106, 112 of the inflexible base 150, with an attachment means such as threaded fastener, adhesive, or overmolding. In the present embodiment, the gripping surfaces 200, 201 are durably attached to the orthogonally connected shared surfaces 116, 118 with adhesive.

The minimum width 156, 157, 158, 159 of the inflexible base 150, 152 depends on the coefficient of static friction for the gripping surfaces 200, 201. Standard engineering textbooks provide equations for when sliding starts between two surfaces. By experimentally finding the maximum lateral force exerted onto an incline push-up stabilizer 100, 101, one can use the coefficient of static friction of the gripping surfaces 200, 201 to calculate minimum width.

Each triangular wedge region 106, 112, and 107, 113 extends the minimum width 156, 157, 158, 159 of the inflexible base 150, 152. Each triangular wedge region 106, 112, and 107, 113 has a uniform width. The inflexible base 150, 152 and minimum width 156, 157, 158, 159 prevent the push-up stabilizers 100, 101 from flexing under its intended applied load. The intended applied load being the force exerted by a standard user in performing a push-up.

The user places the gripping surfaces 200, 201 of the incline push-up stabilizers 100, 101 against a suitable support, such as a stair step. The user grasps the incline push-up stabilizers 100, 101 by the handles 102, 103 and performs push-ups. By changing the angle between the user's body and the ground, the user can change the effective force needed to perform push-ups. The maximum working angle for the incline push-up stabilizers 100, 101 is approximately 75° meaning that the user can lower the effective force needed to perform a push-up by about 75%. This greatly facilitates users who are older, injured, or fatigued in performing push-ups.

The spacer 104*a*, 104*b*, 105*a*, 105*b* and inflexible base 150, 151 are fabricated from a strong, environmentally durable material including, but not limited to, wood, nylon, PMMA, PC, ABS, PP, HDPE, LDPE, steel, zinc, or aluminum. In the currently envisioned embodiment, the spacer 104*a*, 104*b*, 105*a*, 105*b* and inflexible base 150, 151 would be integrally molded out of at least one of nylon, PP, ABS, or HDPE. In an alternative embodiment, the handle 102, 103, spacer 104*a*, 104*b*, 105*a*, 105*b* and inflexible base 150, 151 are integrally molded from at least one of nylon, PP, ABS, or HDPE, and the gripping surface 200, 201 of the orthogonally connected shared surfaces 116, 118 and 117, 119 of the inflexible base 150, 151 as well as the gripping surface and texture on the handle 102, 103 are overmolded onto the present invention 100, 101.

I claim:

1. An incline push-up stabilizer device comprising: two individual incline push-up stabilizers, each individual incline push-up stabilizer being comprised of a handle having at least a top surface and a bottom surface;

an integral inflexible base comprised of, a flat, rectangular top region, a top surface, a width, two joined triangular wedge regions, each with a defined apex, integrally joined at a right angle, so as to make a length-wise "W" profile, each triangular wedge region having a uniform width that is identical to the width of the inflexible base and each triangular wedge region having one unshared surface that is not shared with the other triangular wedge region, and one shared surface, wherein the shared surface of each triangular wedge region, having a width identical to the width of the inflexible base and extending the width of the inflexible base, is orthogonally connected to the shared surface of the other triangular wedge region; and wherein the two orthogonally connected shared surfaces act as gripping surfaces that prevent the incline push-up stabilizer from flexing and slipping;

two spacers, interposed between the handle and inflexible base, creating a larger gap between the top surface of the inflexible base and the bottom surface of the handle; and an attaching means.

2. The incline push-up stabilizer device of claim 1, wherein the inflexible base is fabricated from at least one of wood, nylon, poly(methyl-methacrylate) ("PMMA" or tradenames Plexiglass or Lucite®), polycarbonate ("PC" or tradename Lexan®), acrylonitrile butadiene styrene ("ABS"), polypropylene ("PP"), high-density polyethylene ("HDPE"), low-density polyethylene ("LDPE"), steel, zinc, or aluminum.

3. The incline push-up stabilizer device of claim 2, wherein the spacer is fabricated from at least one of wood, nylon, PMMA, PC, ABS, PP, HDPE, LDPE, steel, zinc, or aluminum.

4. The incline push-up stabilizer device of claim 3, wherein the handle is fabricated from at least one of wood, nylon, PMMA, PC, ABS, PP, HDPE, LDPE, steel, zinc, or aluminum.

5. The incline push-up stabilizer device of claim 4, wherein the inflexible base and spacers are integrally molded from at least one of nylon, ABS, PP, or HDPE.

6. The incline push-up stabilizer device of claim 5, wherein the handle is integrally molded with the inflexible base and spacer from at least one of nylon, ABS, PP, or HDPE.

7. The incline push-up stabilizer device of claim 1, wherein the orthogonally connected shared surfaces are covered with a layer of flexible material with high surface friction.

8. The incline push-up stabilizer device of claim 7, wherein the flexible material is at least one of striated rubber, thermo-plastic elastomer ("TPE"), or textured nylon.

9. The incline push-up stabilizer device of claim 7, wherein the layer of flexible material is attached to each orthogonally connected shared surface using at least one of adhesive, threaded fasteners, or an over-molding process.

10. The incline push-up stabilizer device of claim 1, wherein the attaching means is at least one of a threaded fastener, adhesive, or an over-molding process.

11. A method of exercising by a user using an incline push-up stabilizer device comprising the steps of:

grasping two individual incline push-up stabilizers, each incline push-up stabilizer having a high-friction surface which temporarily and securely engages with a flat, immovable surface, wherein each individual push-up stabilizer is comprised of a handle having at least a top surface and a bottom surface;

an integral inflexible base comprised of, a flat, rectangular top region, a top surface, a width, two joined triangular wedge regions, each with a defined apex, integrally joined at a right angle, so as to make a length-wise "W" profile, each triangular wedge region having a uniform width that is identical to the width of the inflexible base, each triangular wedge region has one unshared surfaces that are not shared with the other triangular wedge region, and one shared surface, wherein the shared surface of each triangular wedge region, having a width identical to the width of the inflexible base and extending the width of the inflexible base, is orthogonally connected to the shared surface of the other triangular wedge region; and wherein the two orthogonally connected shared surfaces act as gripping surfaces that prevent the incline push-up stabilizer from flexing and slipping;

two spacers, interposed between the handle and inflexible base, creating a larger gap between the top surface of the inflexible base and the bottom surface of the handle;

wherein the inflexible base and its width prevent the device from flexing under its intended applied force;

placing each individual incline push-up stabilizer on the flat, immovable surface;

performing a push-up exercise while grasping the two individual push-up stabilizers that have been placed on the flat, immovable surface.

12. The method of exercising using an incline push-up stabilizer device of claim 11, wherein the flat, immovable surface is a stair.

13. The method of exercising using an incline push-up stabilizer device of claim 12, wherein an effective weight experienced by the user in performing the push-up exercise is reduced or increased by selecting a higher or lower stair on which to place the incline push-up stabilizers.

* * * * *